US005600097A

United States Patent [19]

Bleich et al.

[11] Patent Number: 5,600,097

[45] Date of Patent: Feb. 4, 1997

[54] FIRE RESISTANT CABLE FOR USE IN LOCAL AREA NETWORK

[75] Inventors: Larry L. Bleich; Warren F. Moore, both of Omaha; Stephen T. Zerbs, Gretna, all of Nebr.

[73] Assignee: Lucent Technologies Inc., Murray Hill, N.J.

[21] Appl. No.: 334,657

[22] Filed: Nov. 4, 1994

[51] Int. Cl.[6] ..... H01B 7/00; H01B 7/28

[52] U.S. Cl. ..... 174/110 R; 174/110 F; 174/113 R; 174/121 A

[58] Field of Search ..... 174/113 R, 121 A, 174/110 R, 110 PM, 110 F, 120 R; 428/379, 375, 921

[56] References Cited

U.S. PATENT DOCUMENTS

| | | | |
|---|---|---|---|
| 3,620,899 | 11/1971 | Kelly et al. | 161/162 X |
| 3,941,908 | 3/1976 | Valia et al. | 428/379 |
| 3,978,275 | 8/1976 | Ishihara et al. | 174/34 X |
| 4,123,585 | 10/1978 | Sprazak et al. | 428/379 |
| 4,284,842 | 8/1981 | Arroyo et al. | 174/107 |
| 4,319,940 | 3/1982 | Arroyo et al. | 156/56 |
| 4,412,094 | 10/1983 | Dougherty et al. | 174/110 F |
| 4,447,569 | 5/1984 | Brecker et al. | 524/109 X |
| 4,500,748 | 2/1985 | Klein | 174/121 A |
| 4,510,348 | 4/1985 | Arroyo et al. | 174/121 A |
| 4,595,793 | 6/1986 | Arroyo et al. | 174/121 A |
| 4,605,818 | 8/1986 | Arroyo et al. | 174/107 |
| 4,741,865 | 5/1988 | Kintz et al. | 252/609 X |
| 4,892,683 | 1/1990 | Naseem | 252/609 X |
| 4,941,729 | 7/1990 | Hardin et al. | 350/96.23 |
| 5,013,782 | 5/1991 | Tateno | 524/417 |
| 5,024,506 | 6/1991 | Hardin et al. | 350/96.23 |
| 5,036,121 | 7/1991 | Coaker et al. | 524/100 X |
| 5,074,640 | 12/1991 | Hardin et al. | 385/109 |
| 5,162,609 | 11/1992 | Adriaenssens et al. | 174/34 |
| 5,173,960 | 12/1992 | Dickinson | 385/100 X |
| 5,227,417 | 7/1993 | Kroushl, III | 524/114 X |
| 5,356,710 | 10/1994 | Rinehart | 428/378 X |
| 5,414,035 | 5/1995 | Lindner et al. | 524/181 X |

*Primary Examiner*—Kristine L. Kincaid
*Assistant Examiner*—Chau N. Nguyen

[57] ABSTRACT

A fire retardant cable for use primarily as a riser cable in buildings has a plurality of groups of twisted pairs of conductors arranged in a "honeycomb" structure. Each conductor comprises a metallic conducting member encased in a single layer of a non-flame retardant polyolefin material such as high density polyethylene. The groups of conductors are surrounded by a jacket of flame retardant poly(vinyl chloride) material.

12 Claims, 2 Drawing Sheets

FIG. 2

TABLE I
SRL MARGINS IN dB
(1 - 100 Mhz)

| CABLE | CURRENT STANDARD CABLE | | | | CABLE OF FIG. 1 | | | |
|---|---|---|---|---|---|---|---|---|
| FREQUENCY SEGMENTS | 1 | 2 | 3 | 4 | 1 | 2 | 3 | 4 |
| MIN | 2.4 | 1.9 | 1.5 | 0.1 | 11.1 | 9.2 | 9.1 | 7.8 |
| MAX | 14.5 | 15 | 18.4 | 9.4 | 17.9 | 15.9 | 17.8 | 13.5 |
| AVERAGE | 8.5 | 7.4 | 8.3 | 5.9 | 14.2 | 13.4 | 12.7 | 10.8 |

SEGMENT 1 = 1-10 Mhz
SEGMENT 2 = 10-16 Mhz
SEGMENT 3 = 16-20 Mhz
SEGMENT 4 = 20-100 Mhz

FIRE RESISTANT CABLE FOR USE IN LOCAL AREA NETWORK

FIELD OF INVENTION

This invention relates to fire resistant multi-pair telecommunications cables (backbone cables) for transmitting high frequency signals and, more particularly, to such a cable for use in local area network riser cable applications for transmitting digital signals without degradation thereof.

BACKGROUND OF THE INVENTION

The greatly increased use of computers in offices and manufacturing facilities for data, imaging and video transmission, has given rise to increased demands upon the signal transmitting cable used to interconnect the various electronic peripheral devices with, for example, computers. These demands must be met in order to insure substantially error free signal transmission at high bit rates. In addition, inasmuch as such cables are generally used within a building, the cable must be fire resistant and/or flame retardant.

The danger of the spread of fire is compounded in those cases where the cable extends from floor to floor, in which case it is referred to as a riser cable. This cable is often extended upward or downward for more than two stories, therefore, Underwriters Laboratories performs stringent tests to verify that the cable will perform satisfactorily. This includes a burn test (UL-1666) in order to establish a CMR rating for communications cable used in riser and general purpose applications.

The UL Test 1666, known as a vertical tray test is used by Underwriters Laboratories to determine whether a cable is acceptable as a riser cable. In that test, a sample of cable is extended upward from a first floor along a ladder arrangement having spaced rungs. A test flame producing approximately 527,500 Btu per hour, fueled by propane at a flow rate of approximately 211±11 standard cubic feet per hour, is applied to the cable for approximately thirty minutes. The maximum continuous damage height to the cable is then measured. If the damage height to the cable does not equal or exceed twelve feet, the cable is given a CMR rating approval for use as a riser cable.

There are, in the prior art, numerous cables which perform satisfactorily in a riser application, meeting both the electrical requirements and the flame spread requirement. In U.S. Pat. No. 4,284,842 of Arroyo et al., there is shown one such cable in which the multi-conductor core is enclosed in an inorganic sheath which is, in turn, enclosed in a metallic sleeve. The metallic sleeve is surrounded by dual layers of polyimide tape. The inorganic sheath resists heat transfer into the core, and the metallic sheath reflects radiant heat. Such a cable effectively resists fire and produces low smoke emission, but requires three layers of jacketing material. Another example of a multilayer jacket is shown in U.S. Pat. No. 4,605,818 of Arroyo. In U.S. Pat. No. 5,074,640 of Hardin et al., there is disclosed a cable for use in plenums or riser shafts, in which the individual conductors are insulated by a non-halogenated plastic composition which includes a polyetherimide constituent and an additive system. The jacket includes a siloxane/polyimide copolymer constituent blended with a polyetherimide constituent and an additive system, including a flame retardant system. In U.S. Pat. No. 4,412,094 of Dougherty et al., a riser cable is disclosed wherein each of the conductors is surrounded by two layers of insulation. The inner layer is a polyolefin plastic material expanded to a predetermined percentage, and the outer layer comprises a relatively fire retardant material. The core is enclosed in a metallic jacket and a fire resistant material. Such a cable also meets the requirements for fire resistance and low smoke. However, the metallic jacket represents an added cost element in the production of the cable. In U.S. Pat. No. 5,162,609 of Adriaenssens et al., there is shown a fire resistant cable in which the metallic jacket member is eliminated. In that cable, each conductor of the several pairs of conductors has a metallic, i.e., copper center member surrounded by an insulating layer of solid, low density polyethylene which is, in turn, surrounded by a flame resistant polyethylene material. The core, i.e., all of the insulated conductors, is surrounded by a jacket of flame retardant polyethylene. Such a structure meets the criteria for use in buildings and is, apparently, widely used.

As the use of computers has increased, and more particularly, as the interconnections of computers to each other, and to telephone lines, has mushroomed, a cable for interior use should, desirably, provide substantially error free transmission at very high frequencies. The satisfactory achievement of such transmission has not been fully realized because of a problem with most twisted pair and coaxial cables which, while not serious at low transmission frequencies, becomes acute at the high frequencies associated with transmission at high bit rates. This problem is identified and known as structural return loss (SRL), which is defined as signal attenuation resulting from periodic variations in impedance along the cable. SRL is affected by the structure of the cable and the various cable components, which cause signal reflections. Such signal reflections can cause transmitted or received signal loss, fluctuations with frequency of the received signals, distortion of transmitted or received pulses, increased noise at carrier frequencies and, to some extent, will place an upper signal frequency limit on twisted pair cables. Some of the structural detects that cause SRL are conductors which fluctuate in diameter along their length, or where, for whatever reason, the surface of the wire is rough or uneven. Insulation roughness or irregularities, excessive eccentricity, as well as variations in insulation diameter, may likewise increase SRL. With dual insulated conductors, as shown in the aforementioned Dougherty et al., and Adriaenssens et al., patents, the problem of achieving uniformity of insulation is compounded because of the difficulty of forming a first layer that is substantially uniform and then forming a second, substantially uniform layer over the first. If the first layer is soft or compressible, the second layer can distort it, thereby increasing SRI, to an undesirable level. If, in turn, the second layer is compressible, it can be distorted by the helical member used to bundle the cable pairs, or during the twisting process. Should the conductors of a twisted pair have varying spacing along their length, SRL can be undesirably increased. The presence of metallic shielding members or sleeves can also lead to undesirable increases in SRL.

For a Category V cable, which is the highest category, i.e., the category wherein the cable is capable of handling signals up to 100 MHz, the cable must meet the UL designated EIA/TIA 568 standard rating Proposal 2840 which involves attenuation, impedance, cross-talk, and SRL. For a Category V cable, the SRL, in dB, should be, at 20 MHz, 23 dB or more. For frequencies above 20 MHz, the allowable SRL is determined by $$SRL_f \geqq SRL_{200} - 10\log_{10}\left(\frac{f}{20}\right) \quad (1)$$

where $SRL_{200}$ is the SRL at 20 MHz and f is the frequency. It should be understood that the measured SRL is given by dB below signal and hence, in actuality, is a negative figure.

The difference between the required or allowable SRL and the measured SRL is known as SRL margin. Therefore, the greater the SRL margin of a cable, the better the performance thereof. It can thus be appreciated that the necessity for flame retardance or fire resistance, especially in riser cables, and the desirable end of minimizing SRL, resulting in unimpaired signal transmission, are not amenable to a simple solution. The achievement of a high level of flame retardance by the prior art methods as noted in the foregoing can, and most often does, lead to increased SRL, as does the presence of metallic sleeves or the like. While it is by no means impossible to achieve good SRL characteristics with some of the prior art flame retardant riser cables, the cost involved in assuring uniformity of the various conductors and double insulation layers, while not prohibitive, can be substantially more than is economically feasible.

BRIEF DESCRIPTION OF THE INVENTION

The present invention is aimed at, and achieves the elimination of, the mutual exclusivity of high flame retardance and low SRL. In a preferred embodiment of the invention, a cable suitable for riser installations comprises twenty-five twisted pairs arranged in what is known in the an as "honeycomb" structure. The principles of the invention are applicable to a range of twisted pair cables, from six twisted pairs to one hundred or more twisted pairs. Each conductor of each pair comprises a central metallic conducting member encased in an insulating layer of non-flame retardant polyolefin composition, such as high density polyethylene (HDPE). Such a material can be uniformly extruded and resists distortion by the compressive forces typically encountered in manufacturing and handling the cable. Polyolefins, unless specifically compounded for flame retardance, are highly flammable materials hence the core formed by the several conductors is surrounded by a jacket of highly flame retardant poly(vinyl chloride) (PVC) material. The jacket is comprises of forty-five to fifty percent (45–50%) GP-4 PVC resin; four to six percent (4–6%) stabilizers including three to four percent (3–4%) tribasic lead sulfate; one to two percent (1–2%) lubricants including Henkel G-16 and Henkel G–71; twenty to twenty-four percent (20–24%) plasticizers including up to five percent (5%) 711 phthalate, eleven to thirteen percent (11–13%) tetra-brominated di-2-ethyl-hexyl phthalate, and four to six percent (4–6%) mixed phosphate ester such as Monsanto Santicizer 2248; and twenty to twenty-two percent (20–22%) flame retardants including alumina trihydrate and antimony trioxide. The cable embodying the principles and features of the invention meets the flame retardant requirements for riser cables, but equally as important, gives greater than five dB improvement in SRL margin, without adversely impacting other electrical characteristics. Further, experience has shown that cables manufactured with the prior art have a strong tendency to fail SRL requirements, negatively affecting manufacturing economics. In contrast, cable manufactured with the principles of the invention has exhibited the potential for a ten-fold improvement in SRL failure rate, with an improved SRL margin at all frequencies of use.

The principles and features of the present invention will be more readily apparent from the following detailed description, read in conjunction with the accompanying drawings.

DESCRIPTION OF THE DRAWINGS

FIG. 2 is a table (Table I) comparing certain aspects of the performance of the cable of the invention to those of presently used standard cable.

DETAILED DESCRIPTION

Figure 1:
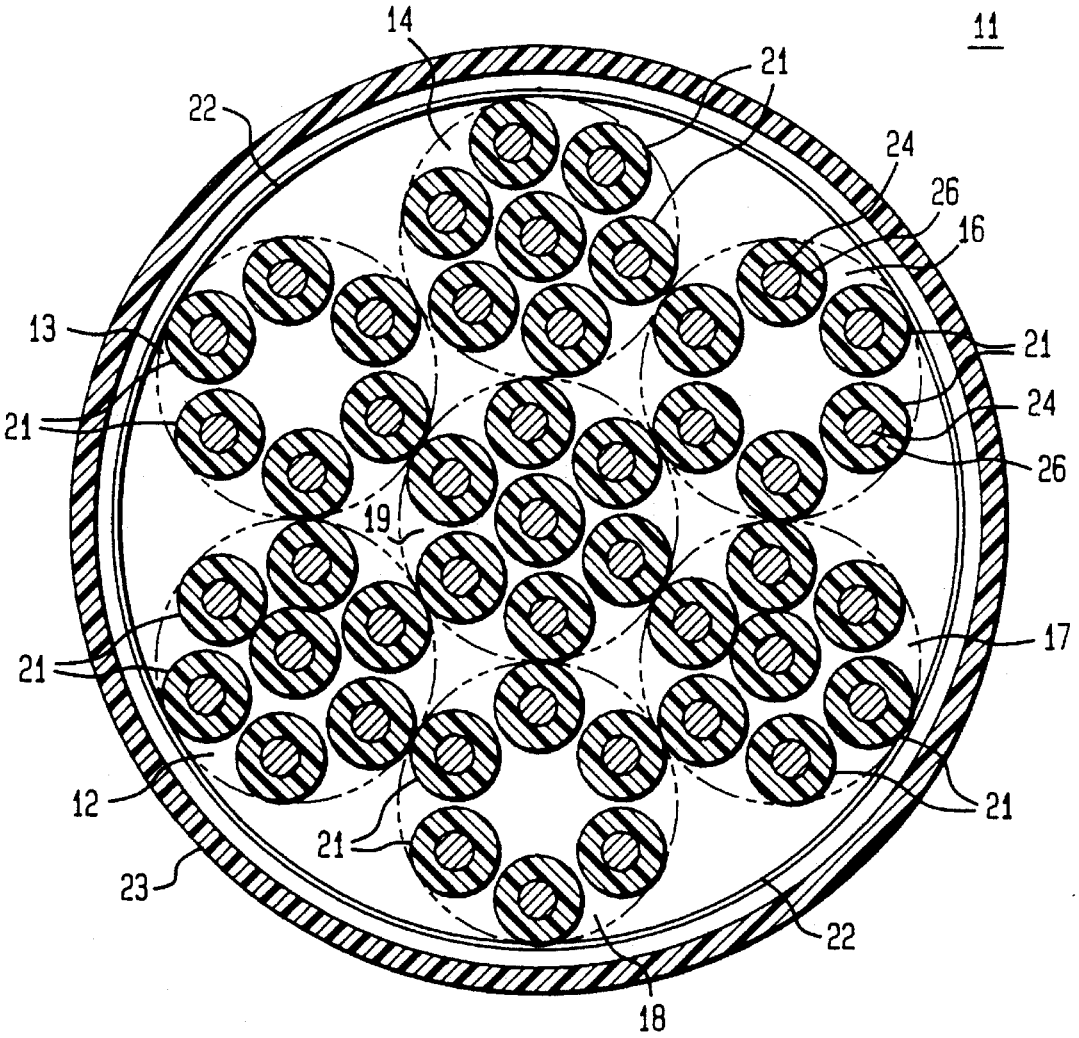
FIG. 1 is a cross-sectional view of the cable of the present invention.

In the preferred embodiment, cable 11 of FIG. 1 comprises seven groups 12, 13, 14, 16, 17, 18 and 19 of twisted-pairs, outlined in dashed lines, each pair of insulated conductors being identified by the reference numeral 21 inasmuch as all of the pairs are identical except for color and twist length. Groups 12, 14, 17 and 19 have four pairs each and groups 13, 16 and 18 have three pairs each. Within each group, the twist length of the pairs differs in order to minimize cross-talk, or inter-pair noise. likewise, each of the groups has a helical twist, and the lay of the groups differs, being 3.6 in group 12, 4.3 in group 13, 3.2 in group 14, 3.7 in group 16, 3.2 in group 18, and 2.5 in group 19. These lays are intended as illustrative examples, and others are possible. However, the different groups, especially those immediately adjacent to each other, should have different lays for best overall performance. The six groups are, in turn, twisted and may be held together by a cable binder such as nylon yarn 22, wound helically about the center of the group. The core thus formed is enclosed within a jacket 23, and the entire assembly is referred to in the art as a "honeycomb" structure.

In accordance with the present invention, each conductor 24 of a twisted pair 21 is encased within an insulating sheath 26 of a polyolefin material such as high density polyethylene (HDPE). HDPE is a relatively tough dielectric material that can be uniformly extruded with a smooth outer surface, a relatively uniform thickness, and adhesion to the conductor 24 that is within allowable limits. Also, the single layer of insulation of the insulating sheath the results in an insulated conductor that is slightly smaller in overall diameter, and with less eccentricity, than the dual layers of insulation in the prior art, thereby enabling somewhat smaller cables of equal capacity. Further, inasmuch as fire retarding the insulation material is not necessary in the cable of the invention, the insulation better resists distortion during the various manufacturing operations, thereby minimizing SRL.

HDPE is a very flammable material and the practice in the prior art has been to use a treated insulating material or an insulating material that is normally fire retardant or, as pointed out in the foregoing, a composite insulation consisting of a minimum of two layers, at least one of which is fire retardant. In practice, with such materials, there has been consistent failure because of SRL, often exceeding ten percent (10%) of cable production. Obviously, the manufacture of such cables is not as economical as is to be desired. In order that the cable of the invention, as depicted in FIG. 1, be suitable for use as a riser cable, it is necessary that the outer jacket 23 be highly fire retardant. In accordance with the principles of the invention, jacket 23 comprises a mixture of PVC material and other ingredients which render it highly flame retardant. It has been found that a mixture comprising one hundred parts by weight per hundred parts resin (PHR) or fifty percent (50%) GP-4 PVC resin; ten and one-half PHR or five and two-tenths percent (5.2%) stabilizers which includes approximately seven PHR or three and one-half percent (3.5%) tribasic lead sulfate; approximately three PHR or one and one-half percent (1.5%) lubricants including Henkel G-16 and Henkel G-71, which are commercially available; approximately forty-four PHR or twenty-two percent (22%) plasticizers including approximately ten PHR or five percent (5%) 711 phthalate, twenty-four PHR or approximately twelve percent (12%) tetra-brominated di-2-ethylhexyl phthalate, and approximately ten PHR or five percent (5%) mixed phosphate ester such as Morrsanto Santicizer 2248; and approximately forty-three PHR or twenty-one percent (21%) flame retardants including forty PHR or twenty percent (20%) alumina trihydrate and approximately three PHR or one percent (1%) antimony trioxide (Theromgard S), produces the desired degree of flame retardance. All of the materials listed are readily available, either as generic materials or as sold under the several trade names. The cable of FIG. 1, constructed as described, with the jacket 23 composed of the materials listed, and with the HDPE-insulated conductors, has been found to meet the requirements of both the National Electric Code and the Underwriters Laboratories for riser cables, which requirements, of course, include fire retardance.

Equally as important, the cable of Fig. I exhibits remarkable improvement in SRL performance. Table I compares the SRL margin, as measured by tests, for a standard, dual-insulated cable, with that of the cable of the invention as depicted in FIG. 1, measured over a frequency range of 0.1 to 125 MHz. The maximum permitted SRL value is 23 dB from 1–20 KHz, and is calculated at frequencies greater than 20 MHz by Equation (1). The frequency range was divided into four segments as shown, and the numbers are the measured SRL margin. Thus, the figure of 9.4 in segment 4 indicates that the measured SRL was 9.4 dB less than the maximum allowable. The cable of the invention as tested had twenty-five twisted pairs with a conductor gauge of from 18 to 28 AWG, and insulation thickness of less than twelve mils (0.012 inches) and a jacket wall thickness of 21 mils (0.021 inches) at any point.

It can be seen from Table I that, in every frequency segment, the cable of the invention exhibits greatly improved SRL margin. Of special interest is the comparative performance of the two cables in segment 4, which represents the high end of the frequency spectrum used, and is the frequency range employed in data transmission, where SRL has its most deleterious effects. The standard cable showed an SRL margin of only 0.1 dB, whereas the cable of the invention exhibited an SRL margin of 7.8 dB. Maximum SRL margin for the standard cable, in segment 4, was measured at 9.4 dB and the maximum for the cable of the invention was 13.5 dB. Most importantly, the average improvement in SRL for the cable of the invention, was measured as approximately 5 dB better than the average for the standard cable. This is a remarkable improvement in SRL performance. It can be appreciated from Table I that the measured SRL margin of 0.1 dB in segment 4, for the standard cable, indicates how nearly such cable approached failure. On the other hand, the cable of the invention, at no time, approached the SRL failure limit. Translated into practical terms, this indicates that the cable of this invention can be manufactured with a substantially lower rejection rate, due to SRL, than prior art cables. This, coupled with the fact that the cable of the invention costs approximately twenty percent (20%) less to manufacture than prior art cables, represents a considerable improvement. In addition to being an economic improvement over prior art cables, the cable of the invention has flame retardant characteristics that are at least the equal of prior art riser cables, and greatly superior SRL performance.

The principles and features of the present invention have been shown and discussed in detail in an illustrative embodiment thereof. Various modifications may occur to workers in the art without departure from the spirit and scope of the invention.

We claim:

1. A fire retardant telecommunications cable for use within a building, which has a low structural return loss, comprising:

a core consisting of a plurality of insulated conductors in groups of twisted pairs wherein the number of twisted pairs in said core is at least five;

each of said conductors having a single, relatively uniform, insulation layer of a non-fire retardant polyolefin composition;

each of said groups of conductors being twisted to have a different lay with respect to each other as a group and the twisted pairs of the groups having two or more different lay lengths; and an outer jacket of flame retardant material surrounding said core;

said cable having a structural return loss (SRL) in a frequency range of 20–100 MHz determined by a formula $SRL_f \geqq SRL_{200} - 10 \log_{10} (f/20)$ where f is the frequency and $SRL_{200}$ is the SRL at 20 MHz and $SRL_{200}$ is at least 23 dB.

2. The cable as claimed in claim 1 wherein said non-fire retardant polyolefin composition comprises high density polyethylene.

3. The cable as claimed in claim 1 wherein said flame retardant material comprises forty-five to fifty percent (45–50%) GP-4 PVC resin; four to six percent (4–6%) stabilizers including three to four percent (3–4%) tribasic lead sulfate; one to two percent (1–2%) lubricants including Henkel G-16 and Henkel G-71; twenty to twenty-four percent (20–24%) plasticizers including up to five percent (5%) 711 phthalate, eleven to thirteen percent (11–13%) tetra-brominated di-2-ethylhexyl phthalate, and four to six percent (4–6%) mixed phosphate ester; and twenty to twenty-two percent (20–22%) flame retardants including alumina trihydrate and antimony trioxide.

4. The cable as claimed in claim 1 wherein the flame retardant outer jacket is a composition constituted of approximately fifty percent (50%) GP-4 PVC resin; approximately five and two-tenths percent (5.2%) stabilizers including approximately three and one-half percent (3.5%) tribasic lead sulfate; approximately one and one-half percent (1.5%) lubricants including Henkel G-16 and Henkel G-71; approximately twenty-two percent (22%) plasticizers including up to five percent (5%) 711 phthalate, approximately twelve percent (12%) tetra-brominated di-2-ethylhexyl phthalate, and approximately five percent (5%) mixed phosphate ester and approximately twenty-one percent (21%) flame retardants including alumina trihydrate and antimony trioxide.

5. The cable as claimed in claim 4 wherein each of said conductors in each said twisted pairs has a gauge of from 18 to 28 AWG.

6. The cable as claimed in claim 5 wherein said cable comprises twenty-five twisted pairs arranged in seven groups, each of said groups being twisted with a twist lay differing from that of adjacent groups.

7. The cable as claimed in claim 6 wherein said insulation layer has a wall thickness of less than twelve one-thousandths (0.012) of an inch.

8. The cable as claimed in claim 7 wherein said outer jacket has a wall thickness of at least twenty-one one-thousandths (0.020) of an inch.

9. The cable as claimed in claim 1 having a fire retardant capability sufficient for use as a riser cable.

10. The cable as claimed in claim 9 wherein said cable is a UL designated Category V cable.

11. A fire retardant telecommunications cable for use as a riser cable, which has a low structural return loss, comprising:

a core including a plurality of insulated conductors in groups of twisted pairs, wherein the number of twisted pairs in said core is at least five;

each of said conductors having a single, relatively uniform, insulation layer of non-fire retardant polyolefin composition;

each of said groups of conductors twisted to have a different lay with respect to each other as a group, and the twisted pairs of the groups having two or more different lay lengths; and an outer jacket of flame retardant material surrounding said core;

wherein said cable has a fire retardant capability sufficient for use as a riser cable and has a structural return loss margin ranging from approximately 7.8 dB to approximately 13.5 dB in a frequency range of 20–100 MHz.

12. A fire retardant telecommunications cable for use within a building, which has a low structural return loss, comprising;

a core including a plurality of insulated conductors in groups of twisted pairs;

each of said conductors having a single, relatively uniform, insulation layer of a non-fire retardant polyolefin composition;

each of said groups of conductors being twisted to have a different lay with respect to each other as a group and the twisted pairs of the groups having two or more different lay lengths; and an outer jacket having a composition constituted of approximately fifty percent (50%) GP-4 PVC resin; approximately five and two-tenths percent (5.2%) stabilizers including approximately three and one-half percent (3.5%) tribasic lead sulfate; approximately one and one-half percent (1.5%) lubricants including Henkel G-16 and Henkel G-71; approximately twenty-two percent (22%) plasticizers including up to five percent (5%) 711 phthalate, approximately twelve percent (12%) tetra-brominated di-2-ethyl-hexyl phthalate, and approximately five percent (5%) mixed phosphate ester; and approximately twenty-one percent (21%) flame retardants including alumina trihydrate and antimony trioxide.

* * * * *